US009216518B2

(12) United States Patent
Frolov

(10) Patent No.: US 9,216,518 B2
(45) Date of Patent: Dec. 22, 2015

(54) POWER EQUIPMENT WITH QUICK RELEASE ANTI-KICKBACK DEVICE

(71) Applicants: Robert Bosch Tool Corporation, Broadview, IL (US); Robert Bosch GmbH, Stuttgart (DE)

(72) Inventor: Andrew Frolov, Glenview, IL (US)

(73) Assignee: Robert Bosch GmbH, Stuttgart (DE)

( * ) Notice: Subject to any disclaimer, the term of this patent is extended or adjusted under 35 U.S.C. 154(b) by 281 days.

(21) Appl. No.: 13/727,858

(22) Filed: Dec. 27, 2012

(65) Prior Publication Data

US 2014/0182434 A1 Jul. 3, 2014

(51) Int. Cl.
*B27G 19/08* (2006.01)

(52) U.S. Cl.
CPC ..... *B27G 19/08* (2013.01); *Y10T 83/2077* (2013.01)

(58) Field of Classification Search
CPC ..... B23D 47/025; B27G 19/00; B27G 19/08; Y10T 83/2077
USPC ..... 83/102.1, 477.2, DIG. 1; 30/288–391
See application file for complete search history.

(56) References Cited

U.S. PATENT DOCUMENTS

| | | | | |
|---|---|---|---|---|
| 4,294,151 | A | 10/1981 | Lemus | |
| 4,721,023 | A | 1/1988 | Bartlett et al. | |
| 6,131,629 | A | 10/2000 | Puzio et al. | |
| 6,170,370 | B1 | 1/2001 | Sommerville | |
| 6,619,347 | B2 | 9/2003 | Jukoff et al. | |
| 6,715,388 | B1 | 4/2004 | Jaksha | |
| 7,210,386 | B1 * | 5/2007 | Chang | B23D 47/025 83/102.1 |
| 7,437,981 | B2 * | 10/2008 | Burke | B27G 19/02 83/102.1 |
| 7,475,621 | B2 | 1/2009 | Wang | |
| 7,549,792 | B2 * | 6/2009 | Bisch | G01K 13/002 374/121 |
| 7,600,456 | B2 * | 10/2009 | Burke | B23D 47/04 83/102.1 |
| 7,971,512 | B2 * | 7/2011 | Tanaka | B27G 19/02 144/251.1 |
| 8,079,295 | B2 | 12/2011 | Gass | |
| 8,104,386 | B2 | 1/2012 | Chen | |
| 8,205,533 | B2 * | 6/2012 | Tanaka | B27G 19/02 144/251.1 |
| 8,893,601 | B2 * | 11/2014 | Chiang | B27B 5/29 83/102.1 |
| 9,038,516 | B2 * | 5/2015 | Chen | B27G 19/08 83/102.1 |
| 2003/0051768 | A1 | 3/2003 | Jukoff et al. | |
| 2006/0042441 | A1 * | 3/2006 | Ichikawa | B27G 19/02 83/102.1 |
| 2006/0219076 | A1 | 10/2006 | Gass et al. | |

(Continued)

OTHER PUBLICATIONS

International Search Report and Written Opinion corresponding to PCT Application No. PCT/US2013/077335, mailed Mar. 18, 2014 (11 pages).

(Continued)

*Primary Examiner* — Ned Landrum
*Assistant Examiner* — Richard Crosby, Jr.
(74) *Attorney, Agent, or Firm* — Maginot Moore & Beck LLP

(57) ABSTRACT

A power equipment in one embodiment includes a riving knife with a circular mounting hole opening to an outer surface of the riving knife through a throat, the throat having a minimum diameter that is less than a minimum diameter of the mounting hole, and an anti-kickback assembly including a generally cylindrical grooved shaft having a first diameter larger than a minimum diameter of the throat and a second diameter smaller than the minimum diameter of the throat, and an actuating arm operably connected to the grooved shaft and configured to rotate the grooved shaft from a first position whereat the second diameter is aligned with the throat and a second position whereat the second diameter is not aligned with the throat.

14 Claims, 8 Drawing Sheets

(56) References Cited

U.S. PATENT DOCUMENTS

| | | | | |
|---|---|---|---|---|
| 2006/0260456 | A1* | 11/2006 | Chang | 83/477.2 |
| 2007/0113715 | A1 | 5/2007 | Burke et al. | |
| 2007/0157784 | A1 | 7/2007 | Gass et al. | |
| 2008/0178722 | A1 | 7/2008 | Gass et al. | |
| 2009/0056514 | A1* | 3/2009 | Chen | B27G 19/02 83/102.1 |
| 2010/0224044 | A1* | 9/2010 | Lee | 83/478 |
| 2010/0282039 | A1* | 11/2010 | Jan | B27G 19/08 83/102.1 |
| 2011/0061506 | A1* | 3/2011 | Frolov | 83/102.1 |
| 2011/0126682 | A1 | 6/2011 | Gass et al. | |
| 2012/0159763 | A1* | 6/2012 | Chiang et al. | 29/428 |

OTHER PUBLICATIONS

Bosch, "Operating/Safety Instructions, 4100/4100DG", 92 pages, published at least as early as Apr. 15, 2013, Taiwan.

DeWalt web site page "DW745 10 Compact Job Site Table Saw with Site-Pro Modular Guarding System"; http://www.dewalt.com/tools/machinery-portable-table-saws-dw745_2.aspx; published at least as early as Mar. 4, 2008; 1 page.

Hitachi Koki, "Hitachi Model C 10RB, Instruction Manual and Safety Instructions", 76 pages, published at least as early as Apr. 15, 2013, Taiwan.

Makita, "Instruction Manual, Table Saw 2704", 48 pages, published at least as early as Apr. 15, 2013.

* cited by examiner

POWER EQUIPMENT WITH QUICK RELEASE ANTI-KICKBACK DEVICE

FIELD

The present disclosure relates to power equipment and more particularly to power equipment with exposed shaping devices.

BACKGROUND

A number of power equipments have been produced to facilitate forming a work piece into a desired shape. One such power equipment is a table saw. A wide range of table saws are available for a variety of uses. Some table saws such a cabinet table saws are very heavy and relatively immobile. Other table saws, sometimes referred to as jobsite table saws, are relatively light. Jobsite table saws are thus portable so that a worker can position the table saw at a job site. Some accuracy is typically sacrificed in making a table saw sufficiently light to be mobile. The convenience of locating a table saw at a job site, however, makes job site table saws very desirable in applications such as general construction projects.

All table saws, including cabinet table saws and job site table saws, present a safety concern because the blade is moving at an extremely high speed with a significant torque. A work piece can be thrown back at a user by a rotating blade causing injury and ruining the work piece if safety devices are not used. The potential for such "kickback" is compounded by the fact that the blade makes a very narrow cut in the work piece. Accordingly, even a slight skewing of the work piece or even cut closing from tension in the work piece can create binding between the blade and the work piece, resulting in kickback. Additionally, some work pieces are not perfectly flat. Consequently, the portion of the work piece which has been cut can twist, causing binding with the blade.

One device which has been developed to reduce the potential for kickback is referred to as a riving knife. A riving knife is located at the rear portion of the table saw, after the blade. The riving knife is aligned with the blade. Accordingly, as the blade cuts the work piece, a "cut" (gap between adjacent cut portions of the work piece) is formed by the blade and the cut is aligned with the riving knife. Consequently, as the work piece is advanced, the riving knife is positioned in the cut, thereby precluding the cut from closing and binding on the blade.

While riving knives are helpful in reducing the potential for kickback, kickback can still occur. Accordingly, a number of table saws are equipped with anti-kickback devices. Anti-kickback devices are typically mounted on the riving knife or a blade guard and consist of two toothed pawls which allow the work piece to move in a single direction in the cutting direction of the saw. Any movement of the work piece in a direction opposite to the cutting direction forces the work piece into the teeth of the pawls which restrict further movement.

Anti-kickback devices are very effective at minimizing the danger posed by kickback. There are some shaping operations with cosmetic surfaces, however, which are not easily accomplished when an anti-kickback device is installed. Accordingly, users frequently have occasion to remove the anti-kickback devices for storage and transportation. Many such devices require both hands tools to remove the anti-kickback devices.

Another disadvantage of known anti-kickback devices is the complexity and cost of such devices. A number of components are required in order to properly mount the assembly to a riving knife or blade guard. The increased number of components increases the time and costs associated with manufacturing the anti-kickback device.

In view of the foregoing, it would be advantageous to provide a power tool with an anti-kickback device that is easily removed and installed with one hand. An anti-kickback device with a reduced number of components would also be advantageous.

SUMMARY

In accordance with one embodiment, a power equipment includes a riving knife with a circular mounting hole and a slot opening to an outer surface of the riving knife as a throat, the throat having a dimension that is less than a diameter of the mounting hole, and an anti-kickback assembly including a generally cylindrical grooved shaft with flats having a first diameter larger than a minimum dimension of the throat and flats which are smaller than the minimum dimension of the throat, and an actuating arm operably connected to the grooved shaft and configured to rotate the grooved shaft from a first position whereat the second dimension is aligned with the throat and a second position whereat the second dimension is not aligned with the throat.

In another embodiment, a power equipment includes a riving knife including a mounting portion, and an anti-kickback assembly including a grooved shaft configured to selectively mount to the mounting portion, a body portion rotatably supporting the grooved shaft, and at least one pawl rotatably supported by the body portion, wherein the grooved shaft and the at least one pawl rotate about a common axis.

BRIEF DESCRIPTION OF THE DRAWINGS

The accompanying drawings illustrate various embodiments of the present disclosure and together with a description serve to explain the principles of the disclosure.

Corresponding reference characters indicate corresponding parts throughout the several views. Like reference characters indicate like parts throughout the several views.

DETAIL DESCRIPTION OF THE DISCLOSURE

Figure 1:
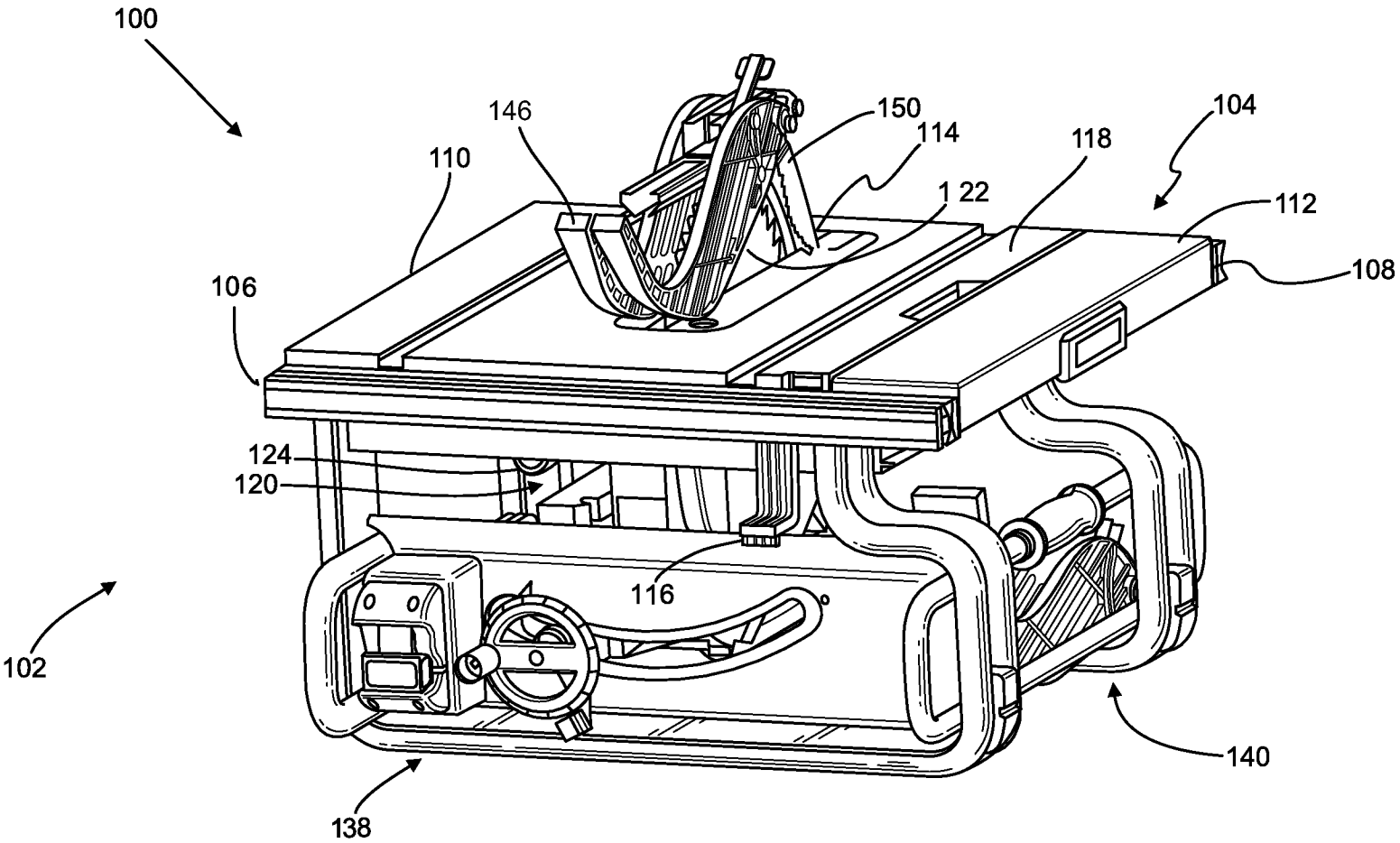
FIG. 1 depicts a perspective view of a table saw assembly according to one aspect of the present disclosure including a work piece support surface, leg units, a saw undercarriage assembly including a motor and a saw blade, with the saw blade shown above the work piece support surface, a blade guard shown above the work piece support surface, and an anti-kickback assembly.

While the power tools described herein are susceptible to various modifications and alternative forms, specific embodiments thereof have been shown by way of example in the drawings and will herein be described in detail. It should be understood, however, that there is no intent to limit the power tools to the particular forms disclosed. On the contrary, the disclosure is to cover all modifications, equivalents, and alternatives falling within the spirit and scope of the disclosure as defined by the appended claims.

Referring to FIG. 1, a table saw assembly 100 is depicted. The table saw assembly 100 includes a support arrangement 102 and a table top assembly 104. The table top assembly 104 includes rails 106 and 108 a main table portion 110, an extension table portion 112, a saw blade opening 114, and a table extension lock lever 116. The saw blade opening 114 is formed substantially centrally in the main table portion 110. The main table portion 110 and the extension table portion 112 define a work piece support surface 118. The extension table portion 112 is positioned aligned with the main table portion 110 and is configured to couple the rails 106 and 108. The table extension lock lever 116 is configured to lock in the extension table portion 112 with the rails 106 and 108.

The table saw assembly 100 also includes a saw assembly or saw undercarriage assembly 120. The saw undercarriage assembly 120 includes a blade 122 rotatably mounted onto a motor 124. The blade 122 is configured to extend through the blade opening 114 and is further configured to raise, lower and bevel with respect to the work piece support surface 118.

Figure 2:
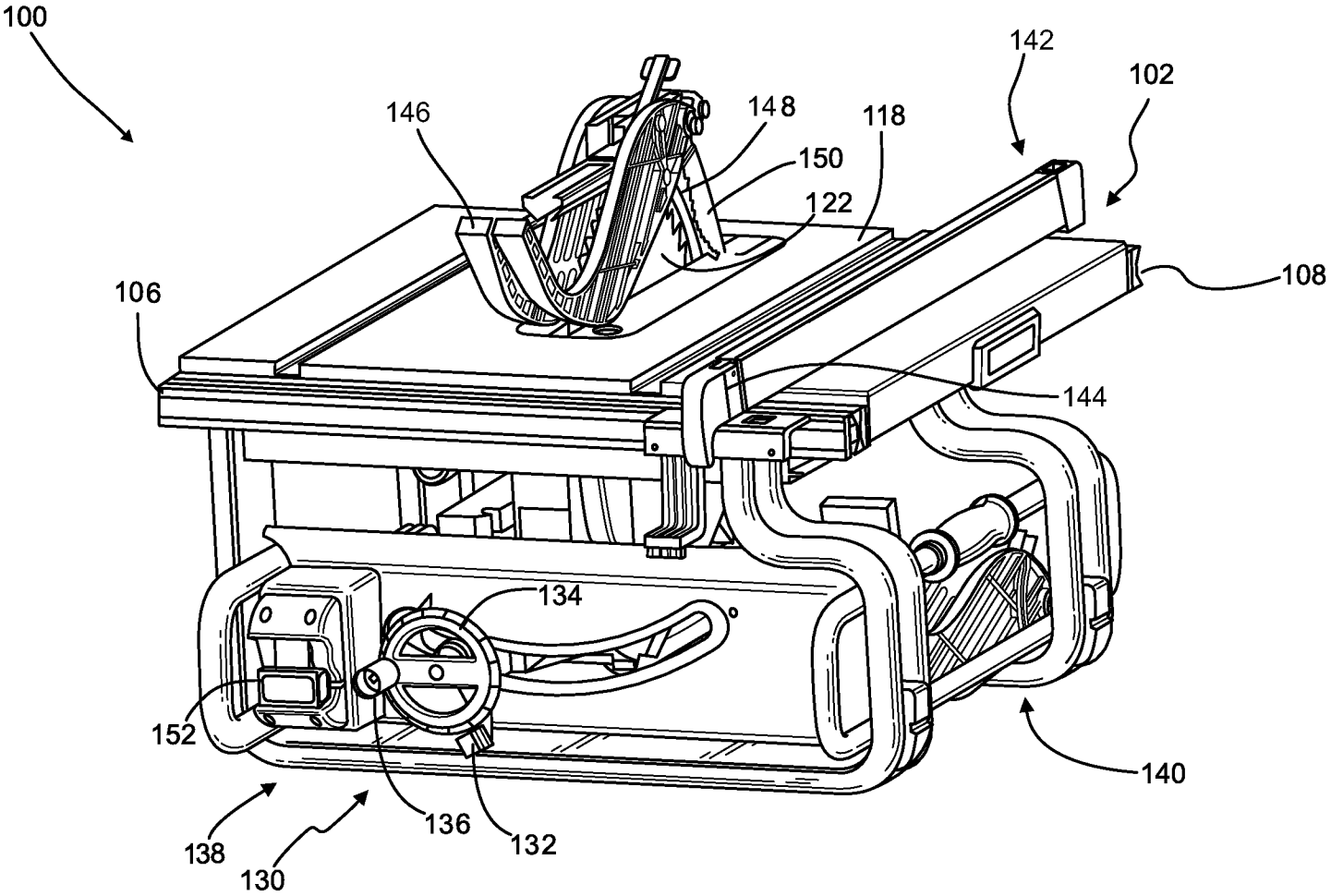
FIG. 2 depicts a perspective view of the table saw of FIG. 1 with a rip fence positioned on the work piece support surface.

The saw assembly 100 also includes an adjustment mechanism 130, depicted and referenced in FIG. 2. The adjustment mechanism 130 includes various actuators such as a bevel adjustment locking lever 132, a height adjustment wheel 134, and a height adjustment wheel handle 136. Note that the height adjustment wheel also functions as a bevel adjustment actuator since side movement of the height adjustment wheel causes the saw blade 122 to bevel in relation to the work piece support surface 118, when the locking lever 132 is in an unlocked position. The support arrangement 102 of the table saw assembly 100 includes front and rear leg units 138 and 140.

As shown in FIG. 2, a rip fence 142 can be positioned above the work piece support surface 118. The rip fence 142 is tightly coupled to the rails 106 and 108 and is lockable in a desired position by a locking handle 144, as is well known to one skilled in the art.

Also depicted in FIG. 2 is a blade guard 146 located in an operative position above the work piece support surface 118. In the operative position, the blade guard is connected to a riving knife 148 which is configured to move with the blade 122. The purpose and configuration of the riving knife 148 is well known to one of ordinary skill in the art. The blade guard 146 surrounds the blade 122 in a manner well known to one of ordinary skill in the art. The blade guard 146 may also be positioned below the work piece support surface 118 in a stowed position.

Further depicted in FIG. 2 is an anti-kickback assembly 150 positioned in an operative position above the work piece support surface 118. The anti-kickback assembly 150 is also connected to the riving knife 148. The anti-kickback assembly 150 may also be stowed under the work piece support surface 118. The purpose and configuration of the anti-kickback assembly 150 is described in further detail below.

Also depicted in FIG. 2 is a power switch assembly 152. The power switch assembly 152 is configured to selectively enable and disable electrical power to the table saw assembly 100.

Figure 3:
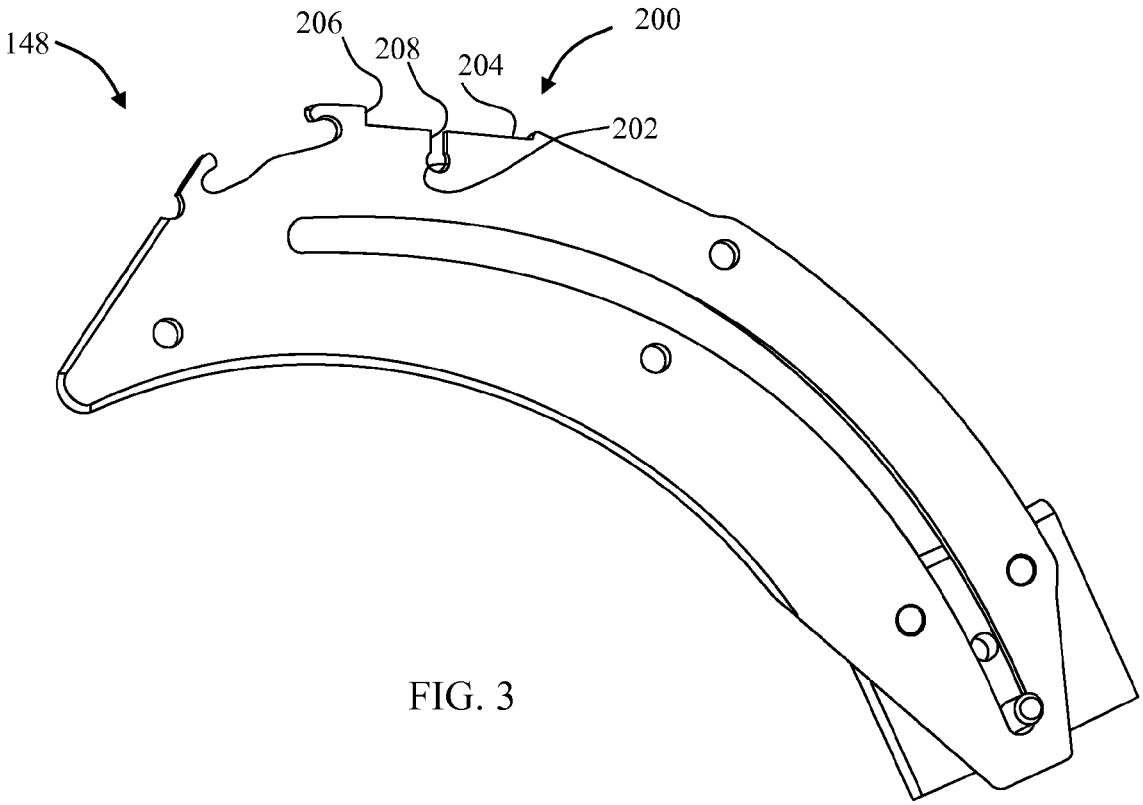
FIG. 3 depicts a perspective view of the riving knife of the table saw of FIG. 1.
Figure 4:
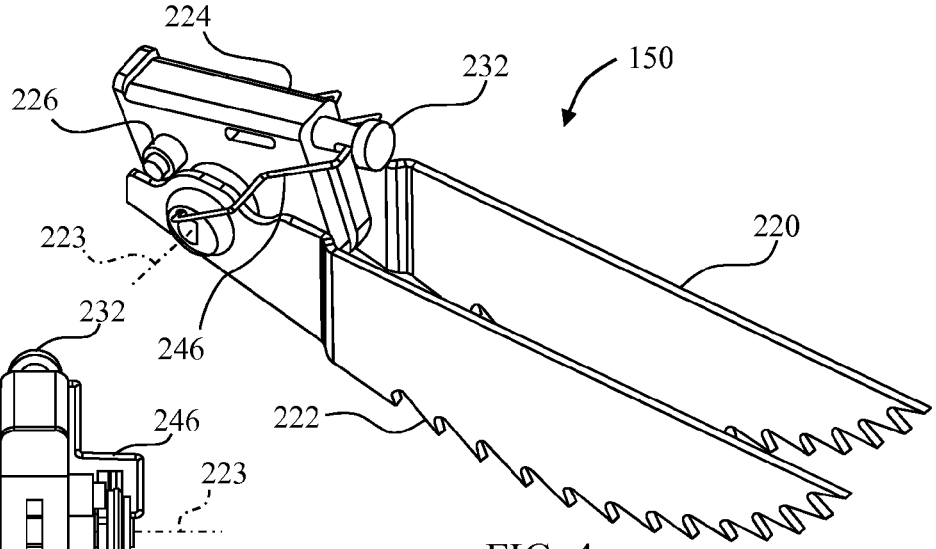
FIG. 4 depicts a top perspective view of the anti-kickback assembly of the table saw of FIG. 1.
Figure 5:
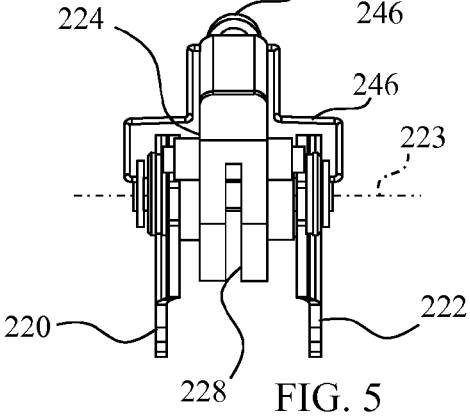
FIG. 5 depicts a front plan view of the anti-kickback assembly of FIG. 4.
Figure 6:
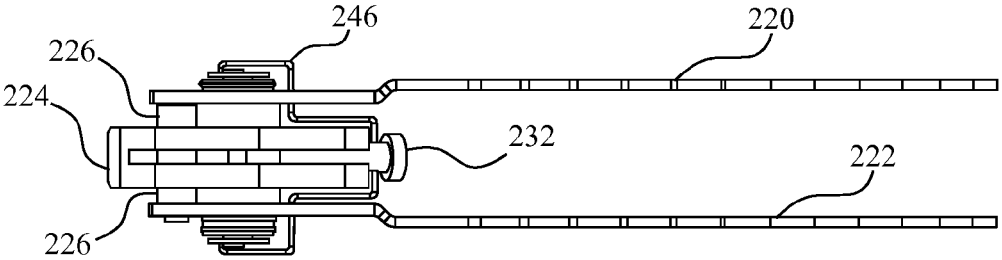
FIG. 6 depicts a top plan view of the anti-kickback assembly of FIG. 4.
Figure 7:
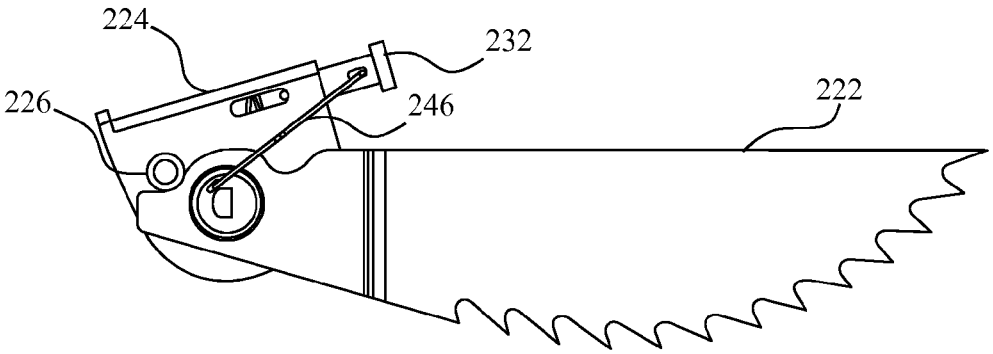
FIG. 7 depicts a side plan view of the anti-kickback assembly of FIG. 4.

The riving knife 148 and anti-kickback assembly 150 of FIGS. 1 and 2 are configured to allow for mounting and release of the anti-kickback assembly 150 to/from the riving knife 148 without the need of any tools. To this end, the riving knife 148, shown in more detail in FIG. 3, includes a mounting portion 200. Within the mounting portion 200, a substantially circular mounting hole 202 opens to the upper outer surface 204 of a notch area 206 through a throat 208. The throat 208 has a minimum diameter which is smaller than the diameter of the mounting hole 202.

With initial reference to FIGS. 4-7, the anti-kickback assembly 150 has a pair of pawls 220/222 which are rotatably attached to a body portion 224. The pawls 220/222 are configured to rotate about an axis 223. A stop pin 226 extends outwardly of both sides of the body portion 224 to limit rotation of the pawls 220/222. The body portion 224 defines a slot 228 which has a width slightly greater than the width of the riving knife 148 at the mounting portion 200.

The body portion 224 further defines a release bore 230 (see FIG. 8) which slidably receives a release pin 232. The release pin 232, also shown in FIG. 9, includes a head 234 and a shaft 236. The release pin 232 is biased in a direction outwardly of the release bore 230 by a release spring 238. A portion of the shaft 236 is maintained within the bore 230 by a stop pin 240 which is positioned within a travel slot 242 of the body portion 224.

Figure 10:
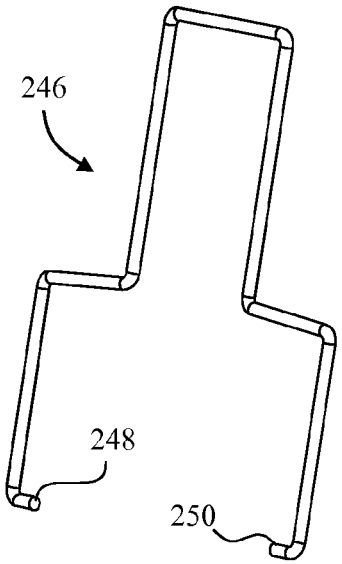
FIG. 10 depicts a perspective view of the actuating arm of FIG. 8.
Figure 11:
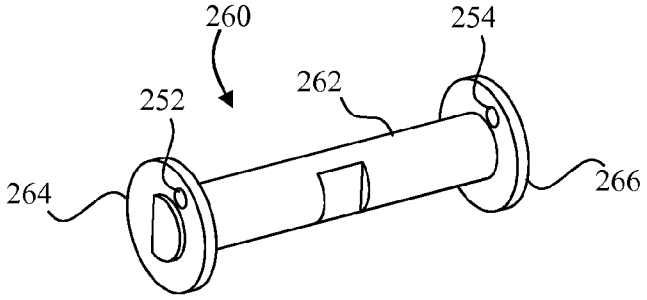
FIG. 11 depicts a perspective view of the grooved shaft assembly of FIG. 8.
Figure 12:
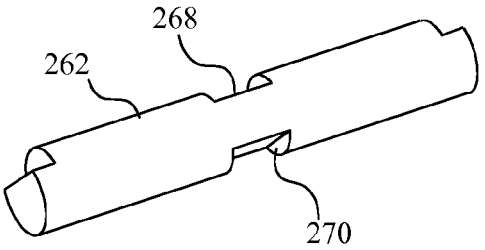
FIG. 12 depicts a perspective view of the grooved shaft of the grooved shaft assembly of FIG. 11.

The release pin 232 further includes a slot 244. An actuating arm 246 extends through the slot 244. As shown in FIG. 10, the actuating arm 246 includes two inwardly extending connecting members 248/250 which are received within two connecting holes 252/254, respectively, of a grooved shaft assembly 260 (see FIG. 11). The grooved shaft assembly 260 is rotatably supported by the body portion 224 and is configured to rotate about the axis 223 of FIG. 4. The grooved shaft assembly 260 includes a grooved shaft 262 and two endplates 264/266. The connecting holes 252/254 are located within the endplates 264/266. The grooved shaft 262 has a generally cylindrical shape and includes two flat notches 268/270 which are shown most clearly in FIG. 12. The notches 268/270 define a smaller dimension portion of the grooved shaft 262.

Figure 13:
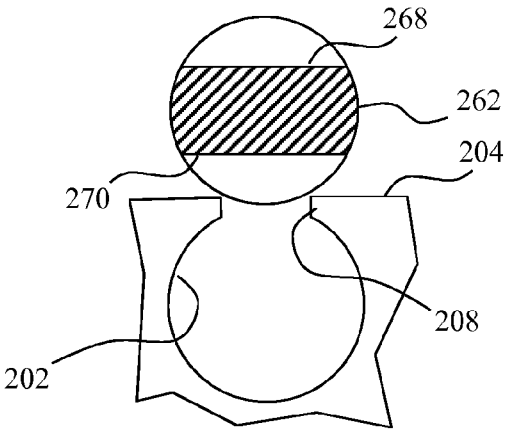
FIG. 13 depicts a partial side view of the mounting portion of the riving knife of FIG. 3 with the grooved shaft of the anti-kickback assembly of FIG. 4 adjacent to and aligned with the throat of the mounting hole and rotated such that a large diameter aspect of the grooved shaft is aligned with the throat.

To attach the anti-kickback assembly 110 to the riving knife 106 or other structure incorporating a mounting portion 200, a user aligns the body portion 224 of the anti-kickback assembly 150 with the notch area 206. Consequently, the slot 228 in the body portion 224 is aligned with the outer surface 204 of the notch area 206 and the shaft 262 of the grooved shaft assembly 260 is aligned with the throat opening 208 of the mounting portion 200 as shown in FIG. 13.

At this point in the process, the notches 268/270 are horizontally oriented. Thus, a larger diameter aspect of the grooved shaft 262 is aligned with the throat 208. Since the larger diameter aspect of the grooved shaft 262 is selected to be much larger than the smallest dimension of the throat 208, the grooved shaft 262 cannot pass through the throat 208.

Figure 8:
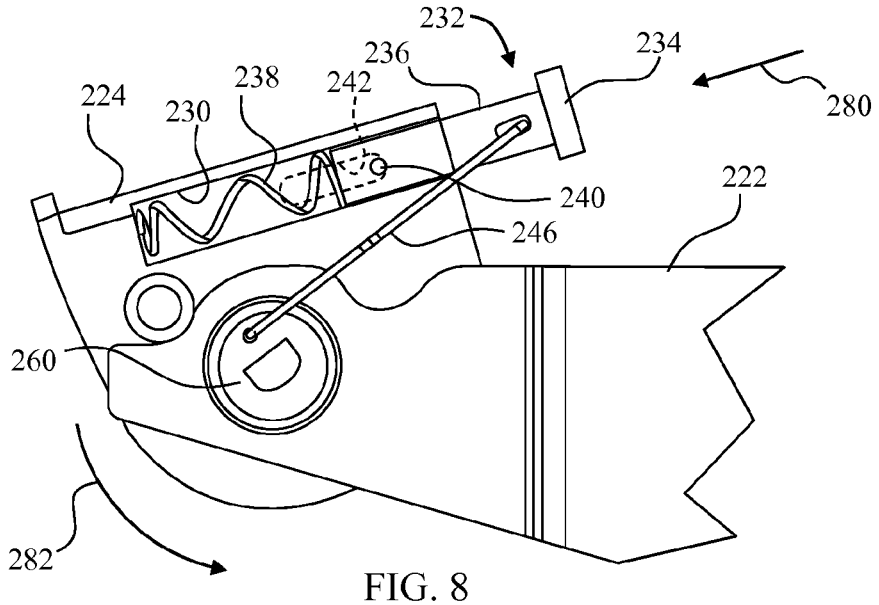
FIG. 8 depicts a partial side plan view of the anti-kickback assembly of FIG. 7 with a portion of the body portion removed to reveal an activation mechanism.
Figure 9:
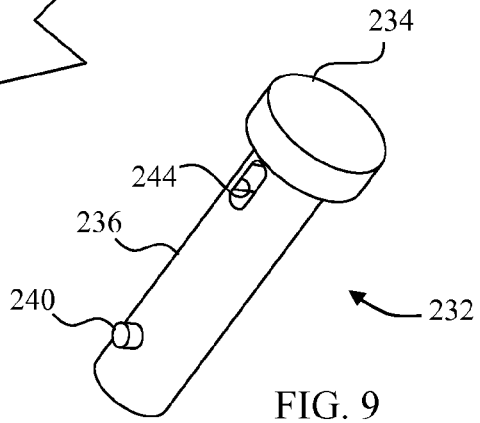
FIG. 9 depicts a perspective view of the release pin of FIG. 8.

By pressing against the head 234 of the release pin 232 in the direction of the arrow 280 of FIG. 8, a user compresses the release spring 238 as the release pin 232 moves in the direction of the arrow 280. Movement of the release pin 232 in the direction of the arrow 280 also forces the actuating arm 246 to move generally in the direction of the arrow 280. Because the connecting members 248/250 are positioned within the connecting holes 252/254 which are offset from the central axis 223 of the grooved shaft 262, movement of the actuating arm 246 causes the grooved shaft 262 to rotate in the direction of the arrow 282.

Figure 15:
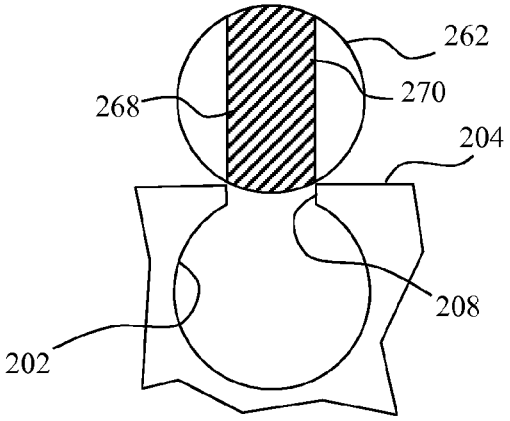
FIG. 15 depicts a partial side view of the mounting portion of the riving knife of FIG. 3 with the grooved shaft of the anti-kickback assembly of FIG. 4 adjacent to and aligned with the throat of the mounting hole and rotated such that a small dimension aspect of the grooved shaft is aligned with the throat.
Figure 14:
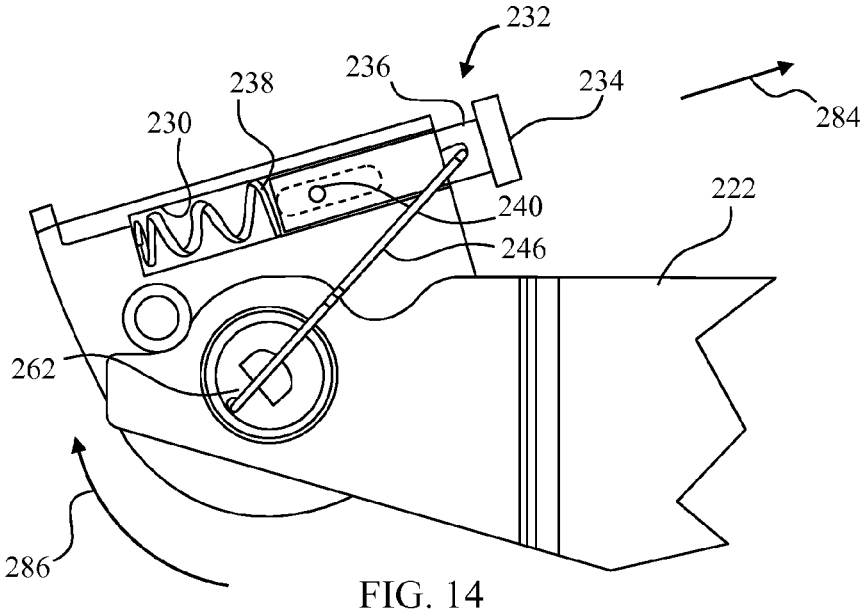
FIG. 14 depicts a partial side plan view of the anti-kickback assembly of FIG. 4 with a portion of the body portion removed to reveal an activation mechanism.
Figure 16:
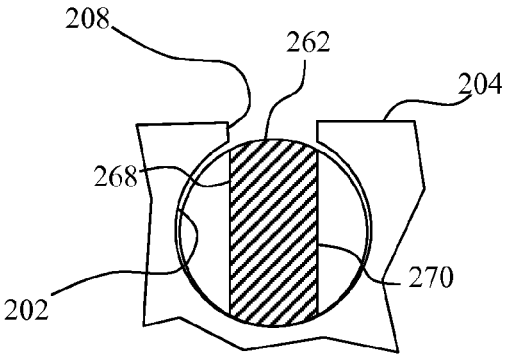
FIG. 16 depicts a partial side view of the mounting portion of the riving knife of FIG. 3 with the grooved shaft of the anti-kickback assembly of FIG. 4 inserted into the mounting hole and rotated such that a small dimension aspect of the grooved shaft is aligned with the throat opening.

Continued movement of the release pin 232 thus results in the configuration of FIG. 14. In the configuration of FIG. 14, the shaft 262 has rotated such that the notches 268/270 are vertically oriented as depicted in FIG. 15. In this orientation, the smaller dimension portion of the grooved shaft 262 defined by the notches 268/270 is aligned with the throat opening 208. Since the smaller dimension portion of the grooved shaft 262 is slightly less than the minimum opening of the throat 208, the user can move the grooved shaft 262 within the throat 208. The depth of the slot 228 in the body portion 224 and the depth of the throat 208 are selected such that a user can move the grooved shaft 262 downwardly through the throat 208 to the position depicted in FIG. 16. In FIG. 16, the grooved shaft 262 is rotatably positioned within the circular mounting hole 202 while the top of the slot 228 (not shown in FIG. 16) is moved to a position adjacent to the outer surface 204 of the mounting portion 200.

The user then releases the release pin 232, which allows the release spring 238 to move the release pin 232 in the direction of the arrow 284 of FIG. 14. Movement of the release pin 232 in the direction of the arrow 284 forces the actuating arm 246 to move generally in the direction of the arrow 284. Because the connecting members 248/250 are positioned within the connecting holes 252/254 which are offset from the central axis 223 of the grooved shaft 262, movement of the actuating arm 246 causes the grooved shaft 262 to rotate in the direction of the arrow 286.

Figure 17:
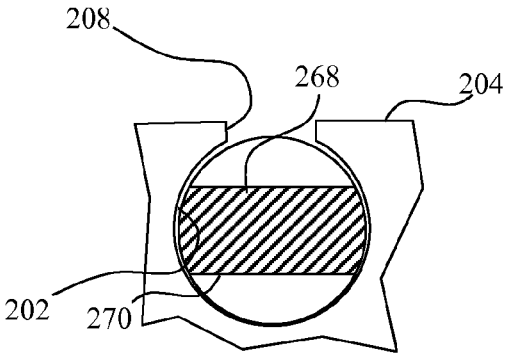
FIG. 17 depicts a partial side view of the mounting portion of the riving knife of FIG. 3 with the grooved shaft of the anti-kickback assembly of FIG. 4 inserted into the mounting hole and rotated such that a small dimension is perpendicular to the throat opening and large diameter aspect of the grooved shaft is locked in the throat.

Continued movement of the release pin 232 thus results in the configuration of FIG. 8. In FIG. 8, the grooved shaft 262 has rotated such that the notches 268/270 are horizontally oriented as depicted in FIG. 17. In this orientation, the diameter of the grooved shaft 262 aligned with the hole 202 is more than the minimum dimension of the throat opening 208. Accordingly, the grooved shaft 262 cannot be removed from the circular mounting hole 202.

When the user desires to remove the anti-kickback assembly 110, the above described process is simply reversed. The above described embodiment thus provides one-handed quick-release mounting and removal of an anti-kickback assembly which has a reduced number of components.

Figure 18:
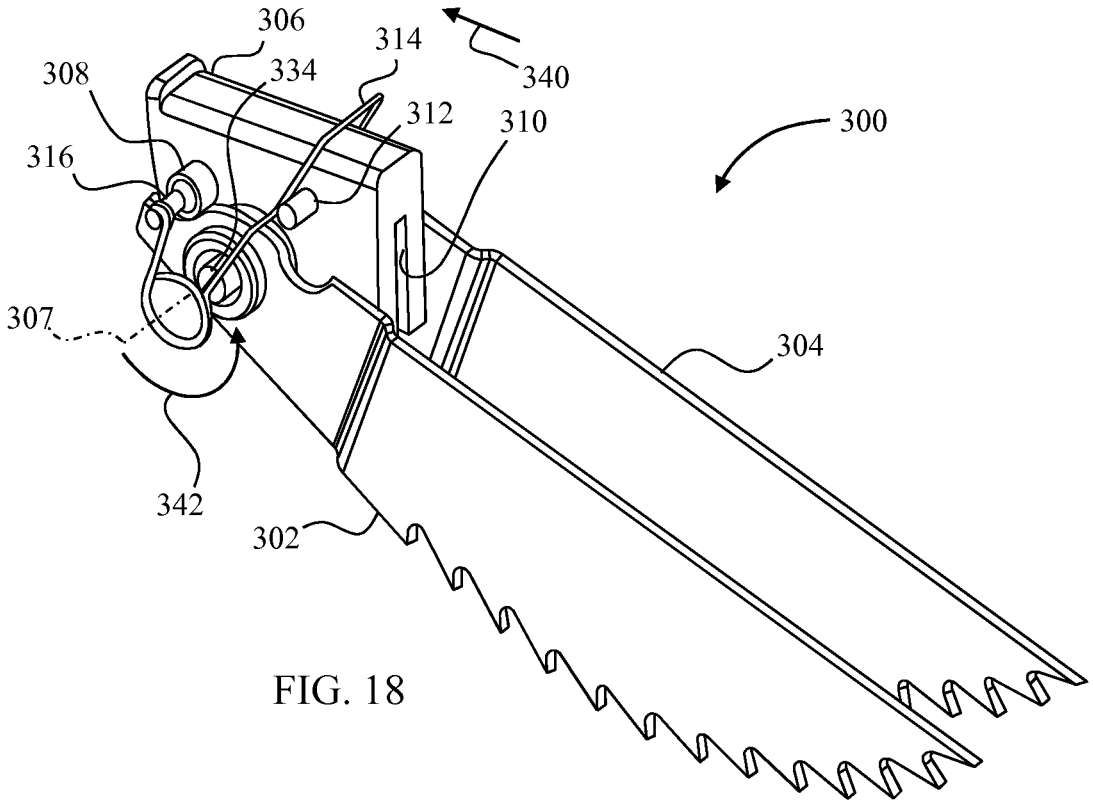
FIG. 18 depicts a top perspective view of another embodiment of an anti-kickback assembly that can be used the table saw of FIG. 1.

FIG. 18 depicts an alternative anti-kickback assembly 300 that can be used with the table saw 100. The anti-kickback assembly 300 has a pair of pawls 302/304 which are rotatably attached to a body portion 306 and configured to rotate about an axis 307. A stop pin 308 extends outwardly of both sides of the body portion 306 to limit rotation of the pawls 302/304. The body portion 306 defines a slot 310 which has a width slightly greater than the width of the riving knife 148 at the mounting portion 200.

Figure 19:
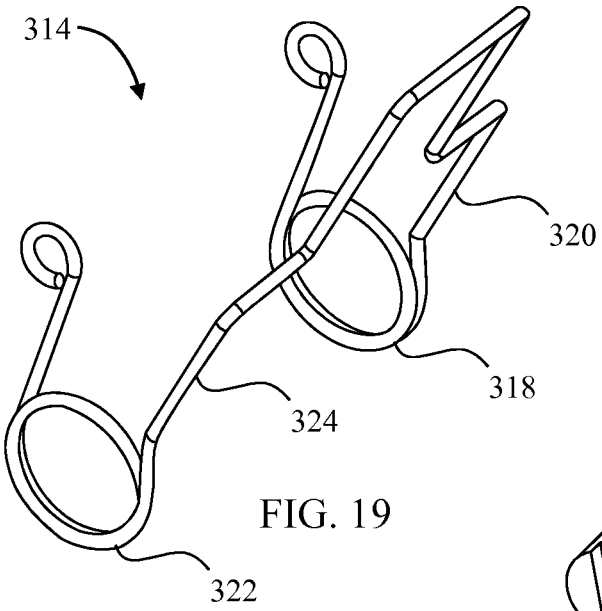
FIG. 19 depicts a perspective view of the torsion spring/actuating arm of FIG. 18.

A travel limiting peg 312 extends outwardly of both sides of the body portion 306 to limit travel of an actuating arm 314. The torsion spring/actuating arm 314 is attached to an anchor pin 316 which extends outwardly from the stop pin 308. The torsion spring/actuating arm 314, also shown in FIG. 19, includes a pair of integrally formed spring coiled portions 318/322 and a pair of actuating portions 320/324 which extend upwardly from the spring portions 318/322.

Figure 20:
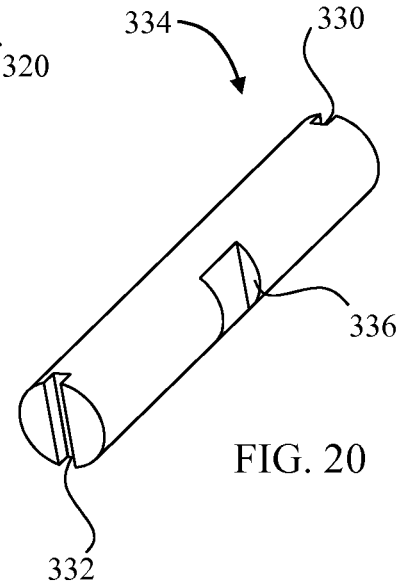
FIG. 20 depicts a perspective view of the grooved shaft assembly of FIG. 18.

The actuating portions 320/324 are engaged with a pair of slots 330/332 in a grooved shaft 334 (see FIG. 20). The generally cylindrical grooved shaft 334 is configured to rotate about the axis 307 and includes two notches 336 (only one is shown in FIG. 20) which are substantially identical to the notches 268/270. The shaft 334 also has notches 332/330 to accept actuating portions 320/324 of spring 314. Returning to FIG. 18, the grooved shaft 334 extends through the body portion 306 and is rotatable with respect to the body portion 306.

Figure 21:
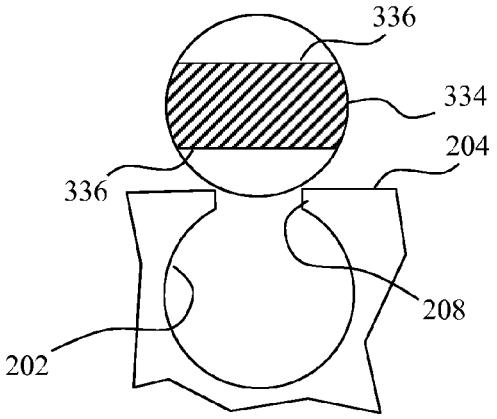
FIG. 21 depicts a partial side view of the mounting portion of the riving knife of FIG. 3 with the grooved shaft of the anti-kickback assembly of FIG. 18 adjacent to and aligned with the throat opening of the mounting hole and rotated such that a large diameter aspect of the grooved shaft is aligned with the throat and smaller dimension is perpendicular to the throat opening.

To attach the anti-kickback assembly 300 to the riving knife 148, a user aligns the body portion 306 of the anti-kickback assembly 300 with the notch area 206. Consequently, the slot 310 in the body portion 306 is aligned with the outer surface 204 of the notch area 206 and the shaft 334 is aligned with the throat 208 of the mounting portion 200 as shown in FIG. 21.

At this point in the process, the notches 336 are horizontally oriented. Since the diameter of the shaft 334 is selected to be much larger than the smallest dimension of the throat opening 208, the shaft 334 cannot pass through the throat 208. By pushing the top of the torsion spring/actuating arm 314 in the direction of the arrow 340 of FIG. 18, a user compresses the spring portions 318/322 and moves actuating portions 320/324, causing the shaft 334 to rotate in the direction of the arrow 342.

Figure 22:
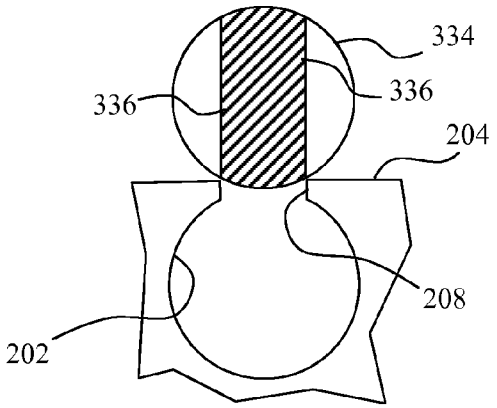
FIG. 22 depicts a partial side view of the mounting portion of the riving knife of FIG. 3 with the grooved shaft of the anti-kickback assembly of FIG. 18 adjacent to and aligned with the throat of the mounting hole and rotated such that a small dimension aspect of the grooved shaft is aligned with the throat.
Figure 23:
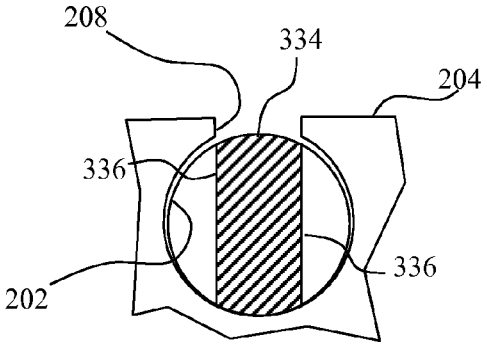
FIG. 23 depicts a partial side view of the mounting portion of the riving knife of FIG. 3 with the grooved shaft of the anti-kickback assembly of FIG. 18 inserted into the mounting hole and rotated such that a small dimension aspect of the grooved shaft is aligned with the throat.

Rotation of the shaft 334 results in the configuration of FIG. 22. In FIG. 22, the shaft 334 has rotated such that the notches 336 are vertically oriented. In this orientation, the smaller dimension portion of the grooved shaft 334 defined by the notches 336 is aligned with the throat opening 208. Since the smaller dimension portion of the grooved shaft 334 is slightly less than the opening of the throat 208, the user can move the shaft 334 within the throat 208. The depth of the slot 310 in the body portion 306 and the depth of the throat 208 are selected such that a user can move the shaft 334 downwardly through the throat 208 to the position depicted in FIG. 23. In FIG. 23, the shaft 334 is rotatably positioned within the circular mounting hole 202 while the top of the slot 310 (not shown in FIG. 23) is moved to a position adjacent to the outer surface 204 of the mounting portion 200.

Figure 24:
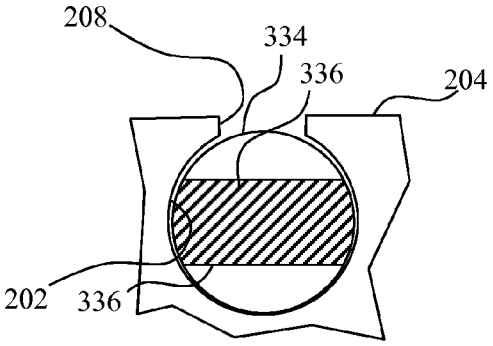
FIG. 24 depicts a partial side view of the mounting portion of the riving knife of FIG. 3 with the grooved shaft of the anti-kickback assembly of FIG. 18 inserted into the mounting hole and rotated such that a large diameter aspect of the grooved shaft is aligned within the hole and smaller dimension is perpendicular to the throat opening.

The user then releases the torsion spring/actuating arm 314, which allows the spring portions 318/322 to move actuating portions 320/324 and return the torsion spring/actuating arm 314 back to the position of FIG. 18 whereat the travel limiting peg 312 stops further movement of the torsion spring/actuating arm 314. In this orientation, FIG. 24, the diameter of the shaft 334 aligned with hole 202 and notches 336 are in general perpendicular to throat opening 208. Shaft diameter is more than the opening of the throat 208 as depicted in FIG. 24. Accordingly, the shaft 334 cannot be removed from the circular mounting hole 202.

When the user desires to remove the anti-kickback assembly 300, the above described process is simply reversed. The above described embodiment thus provides one-handed quick-release mounting and removal of an anti-kickback assembly which has a reduced number of components.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

The invention claimed is:

1. Power equipment, comprising:

a riving knife including a circular mounting hole and an opening to an outer surface of the riving knife through a throat, the throat having a minimum diameter that is less than a minimum diameter of the mounting hole;

an anti-kickback assembly including a generally cylindrical grooved shaft having a grooved portion with a first diameter larger than the minimum diameter of the throat and a second diameter smaller than the minimum diameter of the throat, and an actuating arm operably connected to the grooved shaft and configured to rotate the grooved shaft from a first position whereat the second diameter is aligned with the throat opening and a second position whereat the second diameter is not aligned with the throat;

a body portion including a release hole; and a release pin slidable within the release hole and operably connected to the actuating arm such that movement of the release pin causes rotation of the grooved shaft.

2. The power equipment of claim 1, wherein the body portion rotatably supports the grooved shaft, the power equipment further comprising:

at least one pawl supported by the body portion and rotatable about an axis of rotation, wherein the grooved shaft is rotatable about the axis of rotation.

3. The power equipment of claim 2, wherein:

the actuating arm includes at least one connecting member; and the at least one connecting member is operably connected to an endplate mounted on the grooved shaft.

4. The power equipment of claim 2, further comprising:

at least one biasing member configured to bias the actuating arm toward an actuating arm position whereat the grooved shaft is in the second position.

5. The power equipment of claim 4, wherein:

the biasing member is within the release hole and configured to bias the release pin in a direction outwardly from the release hole.

6. The power equipment of claim 4, wherein:

the grooved shaft includes an end portion assembly;

a hole is formed in the end portion assembly offset from the shaft axle; and an actuating portion of the actuating arm is positioned within the hole.

7. Power equipment, comprising:

a riving knife including a mounting portion; and an anti-kickback assembly including a grooved shaft configured to selectively mount to the mounting portion, a body portion rotatably supporting the grooved shaft; and at least one pawl supported by the body portion and rotatable about an axis of rotation, wherein the grooved shaft is rotatable about the axis of rotation; and an actuating arm operably connected to the grooved shaft and configured to rotate the grooved shaft between a first position whereat the anti-kickback assembly can be removed from the riving knife and a second position whereat the anti-kickback assembly cannot be removed from the riving knife.

8. The power equipment of claim 7, wherein: the actuating arm includes at least one connecting member; and the at least one connecting member is operably connected to an endplate mounted on the grooved shaft.

9. The power equipment of claim 7, further comprising: at least one biasing member configured to bias the actuating arm toward an actuating arm position whereat the grooved shaft is in the second position.

10. The power equipment of claim 9, wherein:

the body portion includes a release hole;

the anti-kickback assembly further comprises a release pin slidable within the release hole and operably connected to the actuating arm; and the biasing member is within the release hole and configured to bias the release pin in a direction outwardly from the release hole.

11. The power equipment of claim 9, wherein the at least one biasing member is formed integrally with the actuating arm.

12. The power equipment of claim 9, wherein:

the grooved shaft includes an end portion;

a slot is formed in the end portion; and an actuating portion of the actuating arm is positioned within the slot.

13. The power equipment of claim 12, wherein the at least one biasing member is formed integrally with the actuating arm.

14. The power equipment of claim 7, wherein:

the riving knife mounting portion comprises a circular mounting hole opening to an outer surface of the riving knife through a throat, the throat having a minimum diameter that is less than a minimum diameter of the mounting hole; and the grooved shaft includes a grooved portion having a first diameter larger than the minimum diameter of the throat and a second diameter smaller than the minimum diameter of the throat, the first diameter and the second diameter located within the mounting hole when the anti-kickback assembly is mounted to the riving knife.

* * * * *